US005615905A

United States Patent [19]

Stepanek et al.

[11] Patent Number: 5,615,905

[45] Date of Patent: Apr. 1, 1997

[54] SYSTEM FOR MODIFICATION OF THE VIBRATIONAL PROPERTIES OF A SKI

[75] Inventors: Premek Stepanek, Garmisch-Partenkirchen; Ludwig Wagner, Farchant, both of Germany

[73] Assignee: Marker Deutschland GmbH, Germany

[21] Appl. No.: 344,563

[22] Filed: Nov. 23, 1994

[30] Foreign Application Priority Data

Nov. 24, 1993 [DE] Germany ..... 93 17 997.9 U

[51] Int. Cl.[6] ..... A63C 5/07

[52] U.S. Cl. ..... 280/602; 280/607; 280/618

[58] Field of Search ..... 280/602, 607, 280/617, 618, 633

[56] References Cited

U.S. PATENT DOCUMENTS

| | | | |
|---|---|---|---|
| 5,269,555 | 12/1993 | Ruffenengo | 280/602 |
| 5,320,377 | 6/1994 | Ruffinengo | 280/602 |
| 5,326,126 | 7/1994 | Ruffinengo | 280/602 |
| 5,437,468 | 8/1995 | Schenner | 280/602 |

FOREIGN PATENT DOCUMENTS

| | | | |
|---|---|---|---|
| 492658A1 | 12/1991 | European Pat. Off. . | |
| 557737A2 | 1/1993 | European Pat. Off. . | |
| 2833393A1 | 2/1980 | Germany | 280/602 |

*Primary Examiner*—Richard M. Camby

*Attorney, Agent, or Firm*—D. Peter Hochberg; Mark Kusner; Michael Jaffe

[57] ABSTRACT

A system for the modification of the vibrational properties of a ski comprised of a support member having a fixed end attached to the ski, and a free end that is movable longitudinally in a holder attached to the ski and is connected by means of a piston with a hydraulic cylinder that is attached to the ski. The free end has an elongated recess in which the hydraulic cylinder is fixed to the ski and is pivotally connected to the piston. This allows the system to be used under tough conditions, protects the hydraulic cylinder from damage, and allows the hydraulic cylinder to be readily replaced.

10 Claims, 4 Drawing Sheets

FIG. 1B

SYSTEM FOR MODIFICATION OF THE VIBRATIONAL PROPERTIES OF A SKI

FIELD OF THE INVENTION

The present invention relates generally to a system for modifying the vibrational properties of a ski. More particularly, the present invention is directed to a hydraulic vibration modifying system comprising a cylinder and piston arrangement that will function in the event of major bending of the ski and the placement of extreme loads upon the ski, and is protected from impacts with foreign objects, such as snow, ice and rocks. Furthermore, the vibration modifying system is arranged for convenient replacement of the hydraulic cylinder.

BACKGROUND OF THE INVENTION

A vibration modifying system comprised of a binding plate, having one end fixedly connected to the ski, and having the other end adapted to be movable in the longitudinal direction within a holder attached to the ski and connected by means of a piston with a hydraulic cylinder fixed to the ski, is known in the prior art. For instance, European Patent Publication No. 492 658 A1 discloses an elongated binding plate having one end which is screwed to the ski at a fixed point. The other end of the binding plate is free to move longitudinally within a holder attached to the ski. A piston is mounted at the front end of the plate and cooperates with a hydraulic cylinder mounted in front of the plate in a fixed manner in relation to the ski. One of the disadvantages of the prior art is that the hydraulic cylinder is not protected from impact with foreign objects, such as snow, ice and rocks. Accordingly, the hydraulic cylinder is vulnerable to being damaged or rendered inoperative.

One object of the present invention is to provide an hydraulic vibration modifying system that is sturdy and durable, and can be used under very tough conditions.

Another object of the present invention is to provide an hydraulic vibration modifying system having a vibration damping system comprised of a cylinder and piston arrangement.

Another object of the present invention is to provide an hydraulic vibration modifying system that allows convenient replacement of components.

Still another object of the present invention is to provide an hydraulic vibration modifying system having a cylinder and piston arrangement which can function in the event of major bending of the ski.

A still further object of the present invention is to provide an hydraulic vibration modifying system having a cylinder and piston arrangement which can function in the event of extreme loads being placed upon the ski.

Yet another object of the present invention is to provide an hydraulic vibration modifying system cylinder and piston arrangement which is protected from contact with foreign objects.

The foregoing and other objects and advantages will become apparent from the following description of a preferred embodiment taken together with the accompanying drawings.

SUMMARY OF THE INVENTION

In accordance with the present invention there is provided an hydraulic vibration modifying system comprising a support member having a fixed end attached to a ski, and a free end movable in the longitudinal direction within a holder which is fixed to the ski. The free end of the support member having an elongated recess, wherein a hydraulic cylinder fixed to the ski is located. A piston cooperates with the hydraulic cylinder and is pivotally connected with the free end of the support member. A cap is plugged on the free end of the support member to at least partially cover the piston and cylinder arrangement.

The foregoing system provides several advantages over the prior art. In this respect, pivotal attachment of the piston with the support member reliably safeguards the piston and cylinder arrangement against damage or breakdown due to major bending of the ski. Furthermore, the particular arrangement of the cylinder, piston and the support member allows the cylinder to be acted upon when opposing bending or counterflexing of the ski occurs. Accordingly, the cylinder provides a damping action during rebounding of the ski. In addition, the particular arrangement of the cylinder, piston and support member allows the hydraulic ski binding to operate reliably and securely under extreme load states. Moreover, by locating the piston and cylinder arrangement within the elongated recess and providing the cap for at least partially covering the piston and cylinder arrangement, the piston and cylinder arrangement is protected against impacts and deleterious effects from the outside.

BRIEF DESCRIPTION OF THE DRAWINGS

The invention may take form in certain parts and arrangement of parts, a preferred embodiment of which will be described in detail in the specification and illustrated in the accompanying drawings which form a part hereof and wherein.

DETAILED DESCRIPTION OF THE PREFERRED EMBODIMENT OF THE INVENTION

Figure 1A:
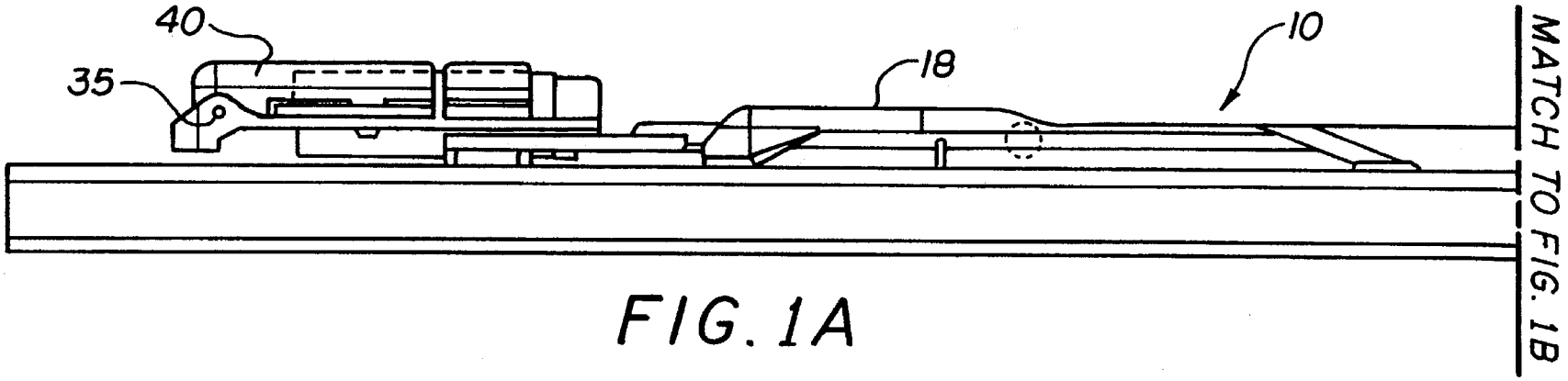
FIG. 1 is a lateral elevation view of the vibration damping system mounted on a ski.
Figure 1B:
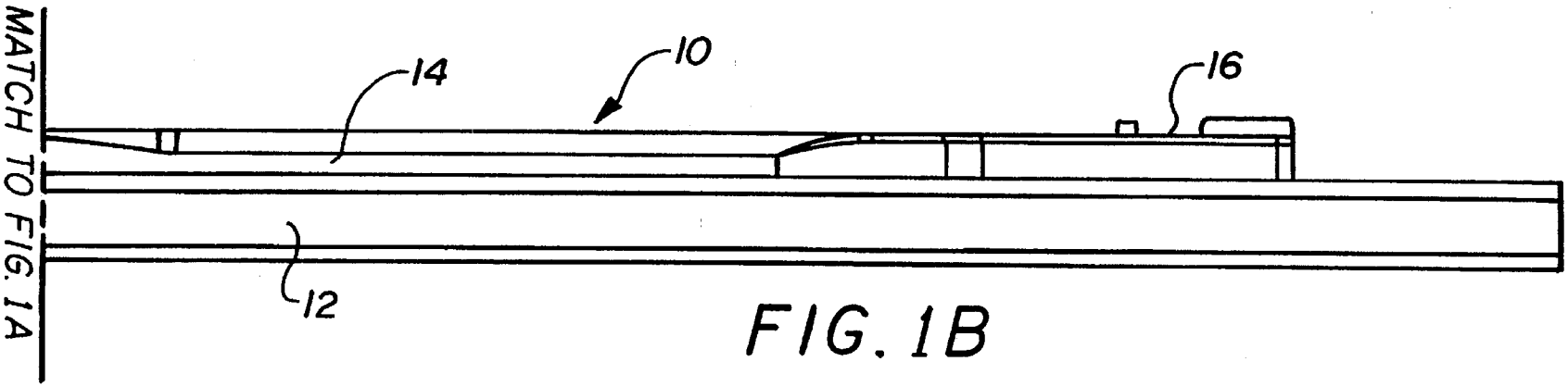
Figure 2A:
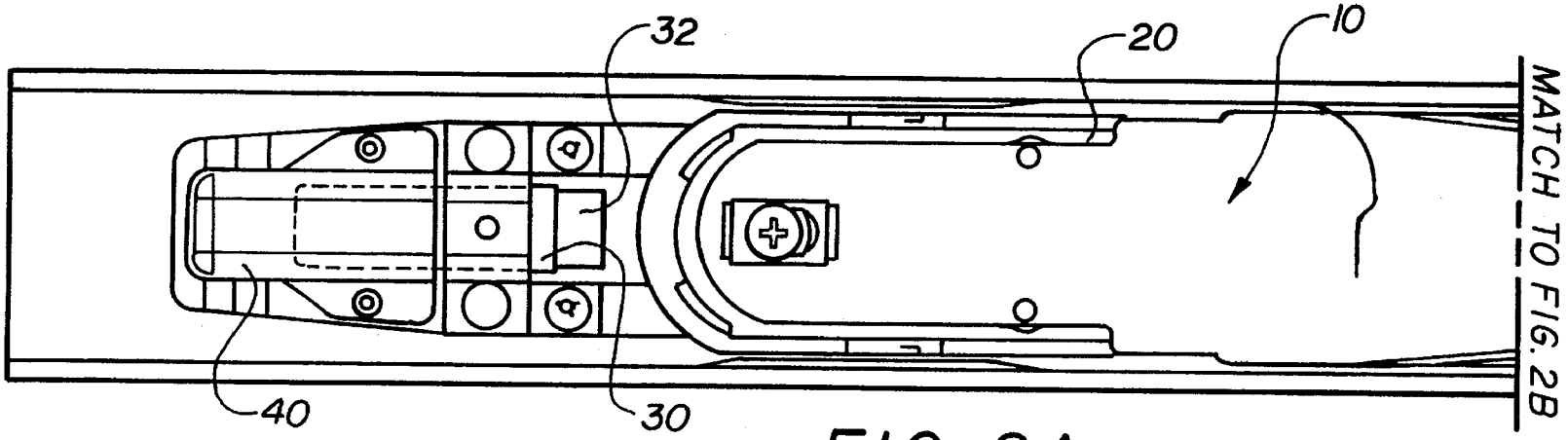
FIG. 2 is a top plan view of the vibration damping system mounted on a ski.
Figure 2B:
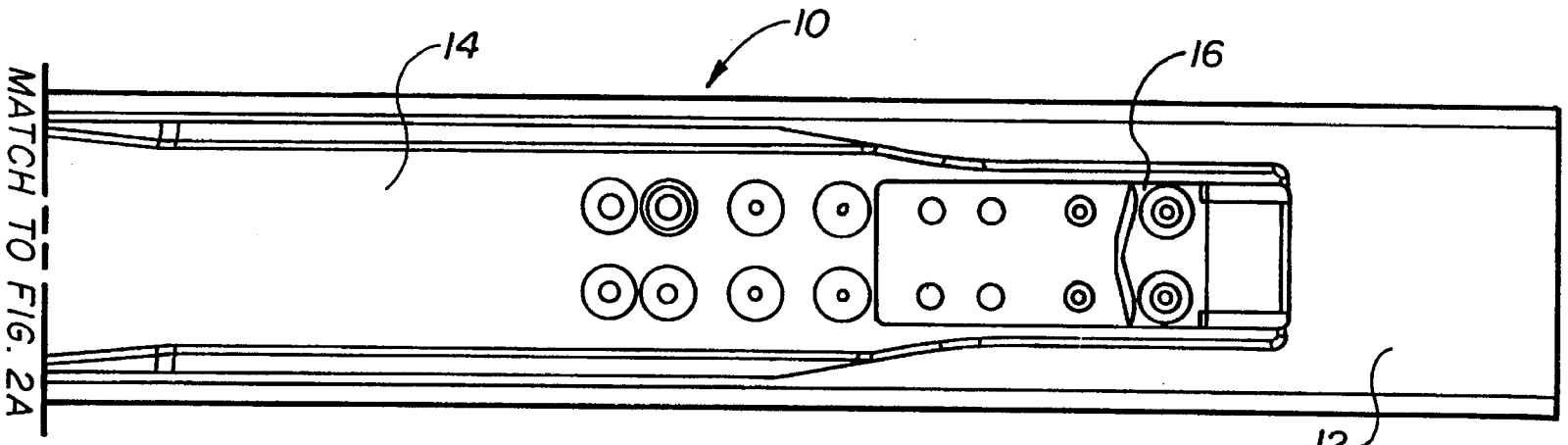
Figure 3:
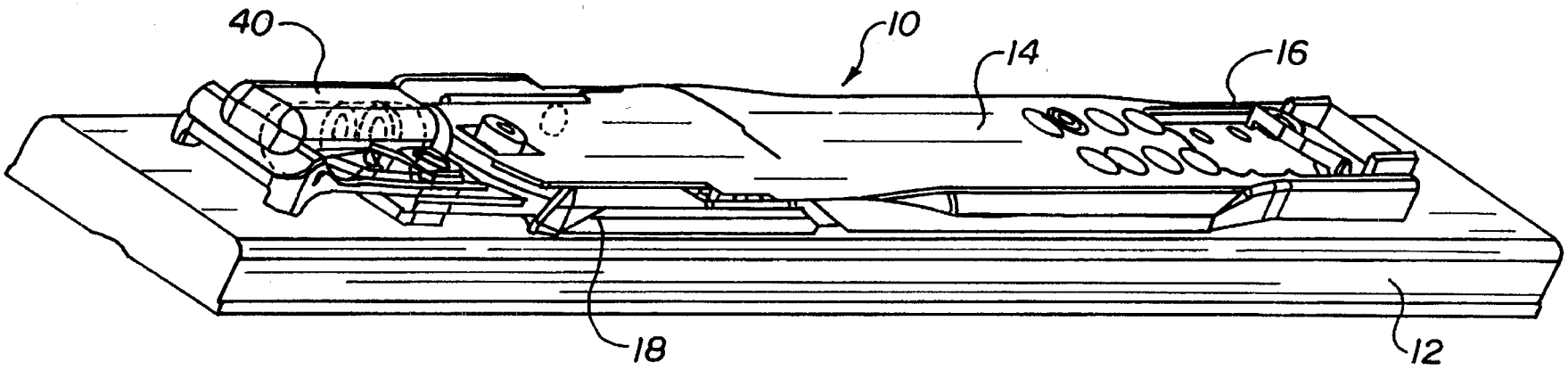
FIG. 3 is a perspective view of the vibration damping system mounted on a ski.

Referring now to FIGS. 1–3, there is shown a vibration modifying system 10 mounted on a ski 12. A ski binding (not shown) is mounted on vibration modifying system 10 to secure a ski boot (not shown) to ski 12.

Vibration modifying system 10 is generally comprised of a support member having a binding plate 14 and a U-like terminating portion 28, a holding means, a vibration damping system, and a cap 40.

Binding plate 14 has a free end and a fixed end 16. Fixed end 16 has at least one hole for receiving fasteners for attaching the fixed end of plate 14 to ski 12. The free end of plate 14 has two lateral projections 22 which form a recess 24 therebetween having an open end. U-like terminating portion 28 has two limbs 26. Each limb 26 is attached respectively by screws to lateral projections 22 of plate 14. Accordingly, U-like terminating portion 28 closes the open end of recess 24, and thereby protects the vibration damping system from impacts and deleterious effects from the outside. U-like terminating portion 28 also has slots 35 which are perpendicular to the longitudinal axis of the support member. It will be appreciated that the binding plate portion 14 and U-like terminating portion 28 may be integral to form a single piece support member. However, such an arrangement may make configuration of the vibration modifying system less convenient.

Figure 4:
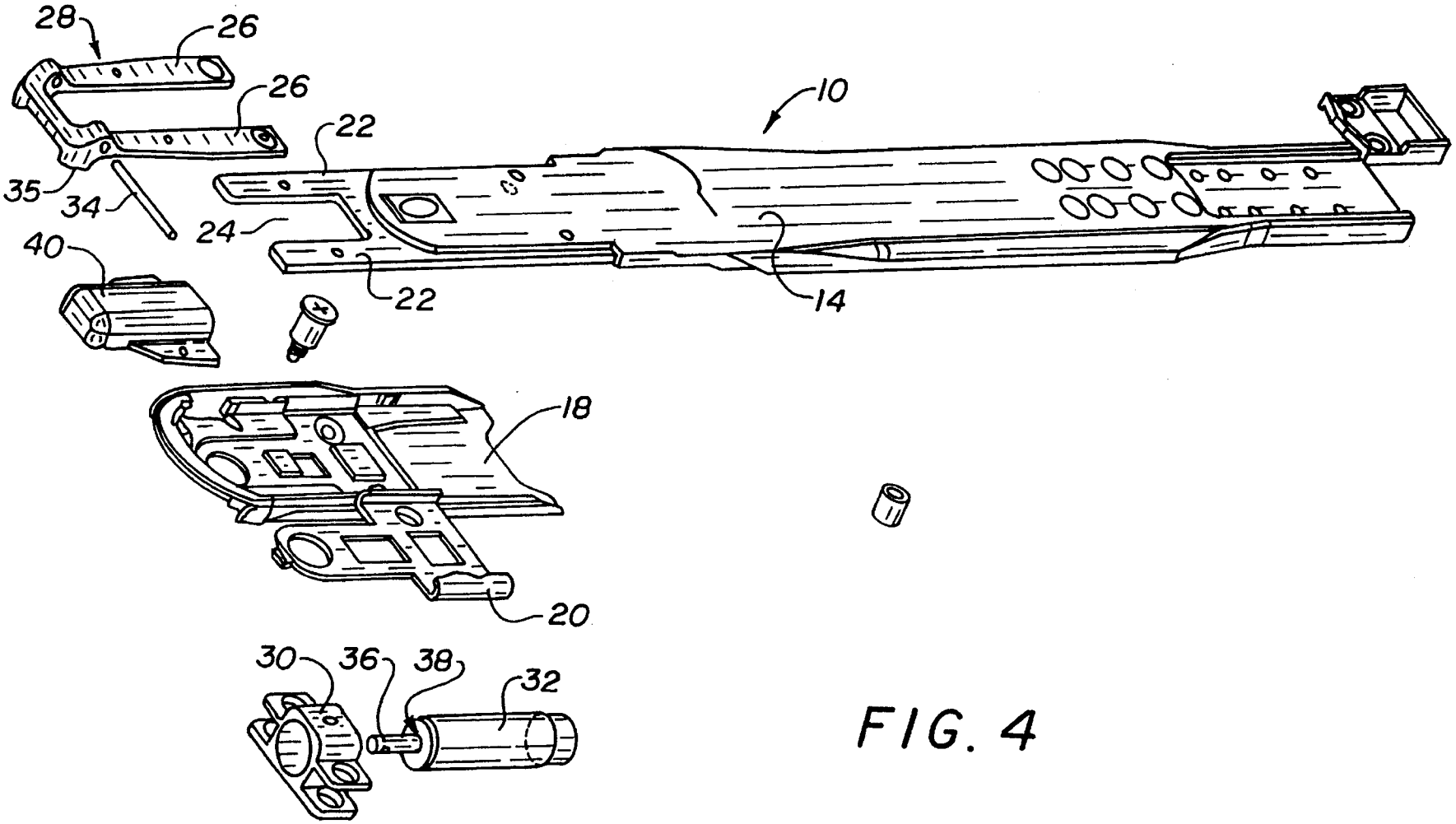
FIG. 4 is an exploded view of the vibration damping system.

The holding means is comprised of holders 18 and 20 which are attached to ski 12 using fasteners, such as screws. Holders 18 and 20 are positioned along ski 12 so that lateral projections 22 of plate 14 extend through and out past holders 18 and 20. Holder 20 grips plate 14 from the side, as best seen in FIGS. 2 and 4.

The vibration damping system is generally comprised of an hydraulic cylinder 32 and a piston 38. Hydraulic cylinder 32 is arranged within recess 24. A coupling 30 is used to fix hydraulic cylinder 32 to ski 12. Piston 38 cooperates with cylinder 32 to damp vibrations. In this respect, one end of piston 38 moves within cylinder 32. At the other end of piston 38, there is a piston rod 36 that is pivotally connected to U-like terminating portion 28. In this regard, a rod 34 extends through slots 35 of plate U-like terminating portion 28 as well as a slot in piston rod 36, as best seen in FIGS. 1 and 4. Rod 34 extends in a direction generally perpendicular to the longitudinal axis of the support member. The pivotal connection of piston rod 36 to rod 34 allows compensation for movement of piston 38 as ski 12 bends.

It will be appreciated that in an alternative embodiment of the present invention piston 38 may be fixed to ski 12, while hydraulic cylinder 32 is pivotally connected to U-like terminating portion 28, at the free end of the support member.

Cap 40 is attached by screws to U-like terminating portion 28. In this respect, cap 40 substantially covers the vibration damping system formed by piston 38 and cylinder 32. Accordingly, cap 40 provides a protective boot as shown in FIGS. 1–3.

The foregoing description is a specific embodiment of the present invention. It should be appreciated that this embodiment is described for purposes of illustration only and that numerous alteration and modifications may be practiced by those skilled in the art without departing from the spirit and scope of the invention. It is intended that they come within the scope of the invention as claimed or the equivalents thereof.

Having described the invention, the following is claimed:

1. A vibration modifying system for a ski, the vibration modifying system comprising:

a support means having a fixed end attachable to a ski and a free end portion having an elongated recess, a holding means, attachable to the ski, for receiving the free end portion of the support means, said free end portion movable longitudinally within said holding means, an hydraulic cylinder fixed to the ski within the elongated recess of said support means, and a piston movable within the hydraulic cylinder and having a piston rod connected in a pivotal fashion with the free end of said support means.

2. A vibration damping system as defined in claim 1, and comprising cover means for covering said hydraulic cylinder and said piston.

3. A vibration modifying system as defined in claim 1, wherein said support means is comprised of:

a plate means having two lateral projections to form therebetween said elongated recess, and a U-shaped terminating portion having two free limbs that are attached, respectively, to the two lateral projections.

4. A vibration modifying system as defined in claim 3, wherein said plate means and said U-shaped terminating portion are integral.

5. A vibration modifying system as defined in claim 3, and comprising rod means extending across the plate at the front end of the U-like terminating portion, said piston rod of said piston pivotally mounted to said rod means.

6. A vibration damping system as defined in claim 1, and further comprising a clamp coupling means for fixing said hydraulic cylinder to the ski.

7. A system for modifying the vibrational properties of a ski, the vibration modifying system comprising:

a support means having a fixed end attachable to a ski and a free end having an elongated recess;

a holding means, attachable to the ski, for receiving the free end of the support means, said free end movable longitudinally within said holding means; and a piston means within a cooperating cylinder means having hydraulic fluid, one of said piston means and said cooperating cylinder means being fixed to the free end of the support means and the other of said piston means and cooperating cylinder means being fixed to said ski.

8. A system for modifying the vibrational properties of a ski, the vibration modifying system comprising:

a support means having a fixed end rigidly attachable to the ski and a free end having an elongated recess;

a holding means, attachable to the ski, for receiving the free end of the support means, said free end movable longitudinally within said holding means; and a piston means within a cooperating cylinder means, one of said piston means and said cooperating cylinder means being fixed to the free end of the support means and the other of said piston means and cooperating cylinder means being fixed to said ski.

9. A system according to claim 7, wherein the free end of said support means is pivotally connected with said piston means.

10. A system according to claim 8, wherein the free end of said support means is pivotally connected with said piston means.

* * * * *